US005376492A

United States Patent [19]

Stelter et al.

[11] Patent Number: 5,376,492

[45] Date of Patent: Dec. 27, 1994

[54] METHOD AND APPARATUS FOR DEVELOPING AN ELECTROSTATIC IMAGE USING A TWO COMPONENT DEVELOPER

[75] Inventors: Eric C. Stelter; Peter S. Alexandrovich, both of Rochester; Joseph E. Guth, Holley, all of N.Y.

[73] Assignee: Eastman Kodak Company, Rochester, N.Y.

[21] Appl. No.: 64,626

[22] Filed: May 20, 1993

[51] Int. Cl.[5] ..... G03G 15/09

[52] U.S. Cl. ..... 430/122; 118/657

[58] Field of Search ..... 430/122, 108; 118/657

[56] References Cited

U.S. PATENT DOCUMENTS

| | | | |
|---|---|---|---|
| 4,473,029 | 9/1984 | Fritz et al. | 118/657 |
| 4,531,832 | 7/1985 | Kroll et al. | 355/3 DD |
| 4,546,060 | 10/1985 | Miskinis et al. | 430/108 |
| 4,565,438 | 1/1986 | Folkins | 355/3 DD |
| 4,647,186 | 3/1987 | Armstrong et al. | 355/15 |
| 4,838,200 | 6/1989 | Hosoi et al. | 118/658 |
| 4,873,551 | 10/1989 | Tajima et al. | 355/251 |
| 4,933,254 | 6/1990 | Hosoi et al. | 430/122 |

*Primary Examiner*—John Goodrow

*Attorney, Agent, or Firm*—Leonard W. Treash, Jr.

[57] ABSTRACT

A two component development system includes developer with charged toner particles and oppositely charged carrier particles having high coercivity and permanent magnetism. The developer is moved through a development zone on a shell and into contact with an image member carrying an electrostatic image by rapidly rotating a magnetic core within the shell. The core has alternating magnetic poles around its periphery. To prevent carryout of carrier on the image member, an AC bias is impressed across the development zone.

9 Claims, 1 Drawing Sheet

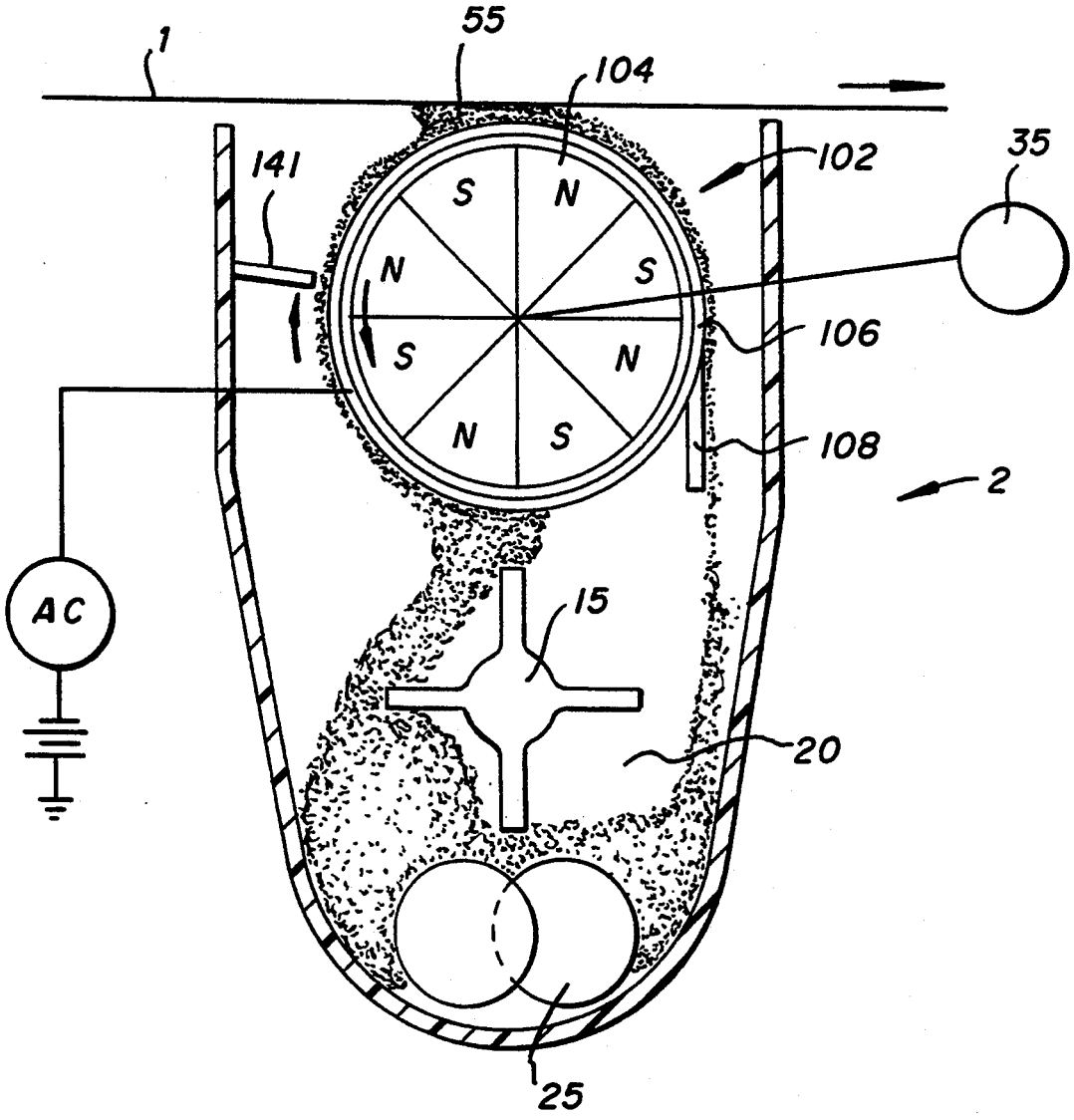
1
55
104
102
35
141
S
N
N
S
S
N
N
S
106
108
2
AC
15
20
25

METHOD AND APPARATUS FOR DEVELOPING AN ELECTROSTATIC IMAGE USING A TWO COMPONENT DEVELOPER

CROSS REFERENCE TO RELATED APPLICATIONS

This application is related to cofiled U.S. patent application Ser. No. 08/065,246, METHOD AND APPARATUS FOR FORMING TWO TONER IMAGES IN A SINGLE FRAME, Joseph E. Guth et al, filed May 20, 1993; U.S. patent application Ser. No. 08/065,248, PRINTHEAD WRITER ASSEMBLY, Frank J. Koetter et al, filed May 20, 1993; U.S. patent application Ser. No. 08/065,249, IMAGE FORMING METHOD AND APPARATUS, Joseph Kaukeinen et al, filed May 20, 1993; U.S. patent application Ser. No. 08/064,621, METHOD OF FORMING TWO TONER IMAGES IN A SINGLE FRAME, Eric C. Stelter et al, filed May 20, 1993; and U.S. patent application Ser. No. 08/064,625, METHOD AND APPARATUS FOR FORMING A COMPOSITE DRY TONER IMAGE, Joseph Kaukeinen et al, filed May 20, 1993.

BACKGROUND OF THE INVENTION

This invention relates to the application of toner to an electrostatic image to create a toner image. More specifically, this invention relates to an improvement in the development of an electrostatic image using a two component developer made up of charged toner particles and oppositely charged hard magnetic carrier particles.

U.S. Pat. No. 4,546,060, Miskinis et al issued Oct. 8, 1985, discloses a method of developing electrostatic images using developer including a "hard" magnetic carrier having a coercivity of at least 300 gauss when magnetically saturated and exhibiting an induced magnetic moment of at least 20 emu/gm of carrier when in an applied field of 1000 gauss. A preferred embodiment of this carrier having much higher coercivity, in the neighborhood of 2000 gauss, with a higher magnetic moment, about 55 emu/gm, is commercially used to provide the highest quality of electrostatic image development presently available. In this method, developer made up of such hard carrier particles and oppositely charged toner particles is moved at the same speed and direction as the image by high speed rotation of a magnetic core within a shell or sleeve on which the developer moves. Rapid pole transitions on the shell are mechanically resisted by the carrier because of its high coercivity. "Strings" or "chains" of the carrier rapidly flip on the shell to move with the toner on the shell through developing relation with the electrostatic image. See, also, U.S. Pat. No. 4,473,029, Fritz et al, and U.S. Pat. No. 4,531,832, Kroll et al. These two patents and the Miskinis patent are hereby incorporated by reference herein.

The rapid pole transitions, for example, as many as 400 per second on the shell surface when at a core speed of 1500 rpm, create great vigorousness in the developer as it moves through the development zone. This vigorousness constantly recirculates the toner to the shell surface and then back to the outside of the nap to provide it with its desired charge for development. It also continually feeds fresh toner to the image. This system provides high density, high quality images at high development speed.

The direct interaction of the developer nap with the image member causes the developer to roll back toward the input side of the development zone. This rollback broadens the contact between the developer and the image member and improves the development completion of the system. However, it also has a tendency to separate the carrier somewhat from the magnetic fields of the core with the result that some carrier particles are picked up in the image itself. This carry out of carrier by the image is a well known phenomenon in two component developing that occurs, to some extent, in virtually all two component, contact systems. Unfortunately, carrier particles have a bad effect, not only on the image itself, but on the rest of the system. They are generally of the wrong charge to transfer but will prevent toner particles from transferring around them, leaving white spots in the image. If they do transfer, they do not necessarily fuse well. These and other problems associated with carrier being carried away by the image are well documented.

A number of approaches have been devised for removing carrier from an image as or after the image member leaves the development station. For example, most image forming apparatus with this problem include a magnetic scavenger which attracts carrier magnetically from the image, either as part of the toning station or downstream of it. It is also known to attract the carrier electrically, since it is charged opposite to the toner. For example, U.S. Pat. No. 4,647,186, issued Mar. 3, 1987 to Armstrong et al, shows the use of a set of wires immediately after the development zone to which an AC potential is applied with a DC component attractive to carrier having a charge opposite that of the toner.

A large number of references suggest that a high voltage AC bias can be impressed upon the electrical field between a magnetic brush and an electrostatic image to increase the development completion of the electrostatic image. See, for example, U.S. Pat. Nos. 4,933,254, Hosoi et al, issued Jun. 12, 1990; 4,873,551, Tajima et al, issued Oct. 10, 1989; 4,838,200, Hosoi et al, issued Jun. 13, 1989; and 4,565,438, Folkins, issued Jan. 21, 1986. Prior commercial applications of the Miskinis method of development have not used an alternating current component to the development electrical field because the vigorousness of the developer movement was considered more than adequate for development completion. Thus, all present commercial applications of this particular system use only a direct current field.

SUMMARY OF THE INVENTION

It is an object of the invention to reduce the amount of carryout in a method and apparatus of toning images of the type disclosed in the Miskinis et al patent.

This and other objects are accomplished by a method and apparatus for toning an electrostatic image carried by an image member, which method is substantially as described in the Miskinis patent but in which an alternating current is impressed between the sleeve or shell and the image member.

We have found the imposition of an alternating current component to the development field remarkably reduced the tendency of carrier to be carried away on the image member.

BRIEF DESCRIPTION OF THE DRAWING

In the detailed description of the preferred embodiments of the invention presented below, reference is made to the accompanying drawing, which is a schematic section of a toning station.

DESCRIPTION OF THE PREFERRED EMBODIMENTS

This invention deals with two component developing. Consistent with the terminology in the art, the term "developer" includes both "carrier" and "toner" which make up the two component system. The carrier includes a magnetizable material and is intended to stay in the development station, preferably until worn out. The toner is charged opposite to the carrier and makes up the toner image. It is constantly replenished in the development station.

According to the drawing, an electrostatic image has been formed on an image member 1. Image member 1 moves through a developing zone in developing relation with a toning station 2. The toning station includes a sump 20 having a pair of augers 25 which continually mix developer and a paddle 15 which contributes to the mixing and also helps supply the developer to an applicator 102. The applicator 102 includes a rotatable magnetic core 104 having alternating magnetic poles around its periphery. The core is rotatable by a motor 35. Around the core is a shell or sleeve 106 which can be stationary or rotatable. This sleeve is preferably nonmagnetic and may be made up of aluminum, stainless steel or other similar material. The toning station also includes an input skive 141 and an output or separation skive 108.

In operation, the sump 20 is charged with developer of the type described in the Miskinis patent. That is, it includes charged toner particles and oppositely charged magnetic carrier particles, which magnetic carrier particles have a coercivity of at least 300 gauss when magnetically saturated and which exhibit an induced magnetic moment of at least 20 EMU/gm of carrier when in an applied field of 1000 gauss. Preferably, the carrier has a much higher coercivity than 300 gauss. A carrier having a coercivity of 2000 gauss and an induced magnetic moment of 55 emu/gm is used commercially.

Operation of mixing augers 25 and paddle 15 thoroughly mix and charge the developer and make it available to applicator 102. Rapid rotation of core 104 in a counter-clockwise direction, as seen in the drawing, creates rapid pole transitions on the surface of sleeve or shell 106. For example, rotation of core 104 between 1000 and 2000 rpm can cause between 200 and 400 pole transitions per second on sleeve 106, depending on the number of poles of the core. These rapid pole transitions are resisted by the carrier because of its high coercivity and permanent magnetism. This resistance causes the carrier to flip, which, in turn, causes it to move in a clockwise direction around sleeve 106 and through a development zone in which it contacts image member 1. The movement of the carrier is extremely vigorous. The carrier itself may form strings which have a tendency to flip forward, lying down during the pole transition and sitting up when the center of the pole is opposite it. The developer, thus, appears to move in a wave formation around sleeve 106 with the crests of the wave opposite the centers of the poles. This vigorousness of the developer causes the carrier and toner to move from the surface of the developer to the sleeve and back again continually, thereby recharging the toner and presenting fresh toner to an electrostatic image carried on image member 1.

For best development, the electrostatic image is moved in the same direction and at the same speed that the developer is moving with the presentation of fresh toner being maintained by the vigorousness of the rotational or flipping movement of the carrier in response to the rapid pole transitions. The sleeve 106 is spaced from the image member 1 by a distance less than the height of the crests of the developer. This brings the developer into direct contact with image member 1 in the development zone. A roll back 55 of developer forms in the development zone as a result of this contact upstream of the closest position between the image member and the sleeve 106. This rollback increases the exposure of the image to the developer. Because the particles in the developer are constantly moving from the sleeve to the outside of the nap, even in the rollback, fresh toner is being supplied to the image throughout the rollback portion. Thus, the rollback contributes to the denseness of the image and the completion of its development. However, the rollback also allows the carrier to become somewhat more separated from the magnetic core 104 which allows carrier particles to occasionally be picked up and carried away by image member 1.

This is a problem well documented in the art of two component magnetic brush development systems. It causes substantial problems downstream in terms of preventing transfer, damage to the photoconductor and also problems associated with cleaning of the image member. It is especially a problem with the type of development shown in the drawing.

We have found that the application of an AC component to the normal bias supplied between the shell 106 and image member 1 substantially reduces the tendency of image member 1 to carry away carrier in this process. The extent of this improvement in carrier reduction is quite remarkable, as illustrated in the following example:

A number of runs were made to tone electrostatic images and measure the amount of carrier pickup in 250 images using DC and DC plus AC development bias. The runs were carried out using a developer station having a 50 mm diameter shell rotating at 60 rpm and a magnetic core rotating at 1100 rpm. The core had 14 poles of alternating polarity of about 850 gauss measured at the shell surface. This work was done with a photoconductor speed of 445 mm/s, corresponding to a 110 ppm copy rate. The concentration of toner was 12 percent toner and 88 percent carrier by weight. The toner charge-to-mass ratio was −23.5 uc/g. The carrier was of coercivity of 2000 gauss and saturation moment of 55 emu/g and was magnetically saturated (permanently magnetized) in a field of 8000 gauss. A skive spaced 0.76 mm from the shell was used to control the height of the crests of the developer, and the shell to photoconductor spacing was 0.58 min. A substantial rollback of developer formed in the development zone. The photoconductor was charger to −420 V, with a DC developer bias of −330 V. Without an AC bias, an average of 0.498 g of carrier that had been picked up onto the photoconductor was measured. The standard deviation for these runs was 0.179 g. With this same DC bias and an additional 1.5 kV peak-to-peak AC square wave bias at 4 kHz, an average of 0.060 g of carrier pickup was measured with a standard deviation of 0.006 g. With the aforementioned DC bias of −330 V and an additional 3 kV peak-to-peak AC square wave bias at 4 kHz, an average of 0.038 g of carrier pickup was measured with a standard deviation of 0.009 g. These results show a remarkably large decrease in the measured developer pickup if an AC bias is added to the DC development bias in this type of brush.

As with nearly all magnetic brush systems, it is desirable also to apply a direct current field between the shell and the image member, encouraging toner toward image areas and away from background areas. The AC component of the field is of much higher potential. We believe its potential and frequency loosen the carrier from the image member, facilitating it being attracted back to the shell by the core.

The invention has been described in detail with particular reference to a preferred embodiment thereof, but it will be understood that variations and modifications can be effected within the spirit and scope of the invention as described hereinabove and as defined in the appended claims.

We claim:

1. A method of reducing carrier carryout while toning an electrostatic image on an image member, said method comprising:

supplying a two component developer to an applicator having a rotatable multipole magnetic core and a shell around at least a portion of the core, the two component developer including charged toner particles and oppositely charged carrier particles which carrier particles comprise a hard magnetic material exhibiting a coercivity of at least 300 gauss when magnetically saturated and an induced magnetic moment of at least 20 EMU/gm of carrier when in an applied field of 1000 gauss, rotating the core to produce rapid pole transitions on the shell to move the developer along the shell in a wave motion and into direct contact with the image member in a development zone, and creating an alternating current field between the shell and the image member.

2. The method according to claim 1 wherein the field has a direct current component which encourages the deposition of toner in image areas but discourages the deposition of toner in background areas.

3. The method according to claim 1 wherein the contact between the two component developer and the image member is sufficient to create a substantial rollback of developer contacting the image member.

4. The method according to claim 1 wherein the coercivity of the carrier is greater than 1000 gauss.

5. The method according to claim 1 wherein the coercivity of the carrier is greater than 1500 gauss.

6. The method according to claim 1 wherein the alternating current field has a voltage in excess of 500 volts and a frequency in excess of 1000 Hertz.

7. Apparatus for toning an electrostatic image carried on an image member, said apparatus comprising:

a supply of two component developer having charged toner particles and oppositely charged carrier particles, the carrier particles including a hard magnetic material exhibiting a coercivity of at least 300 gauss when magnetically saturated and exhibiting an induced magnetic moment of at least 20 EMU/gm of carrier when in an applied field of 1000 gauss, a sump for holding the supply of developer, means for mixing the developer in the sump, an applicator for receiving developer from the sump which applicator includes a rotatable multipole magnetic core and a shell around at least a portion of the core, means for rotating the magnetic core to move developer around the shell in a direction opposite to the direction of rotation of the core and through a development zone in substantial contact with the image member to develop the electrostatic image, and means for applying an electric field between the sleeve and the image member which electric field has a substantial alternating current component.

8. Apparatus according to claim 7 further including means for impressing a DC component on the electric field between the shell and the image member.

9. Apparatus according to claim 7 wherein the shell and image member are spaced by a distance sufficiently small that contact between the developer and the image member causes a substantial rollback of developer in contact with the image member.

* * * * *